US012359396B2

(12) United States Patent
Gentle et al.

(10) Patent No.: US 12,359,396 B2
(45) Date of Patent: Jul. 15, 2025

(54) DAMAGE AVOIDANCE SYSTEMS AND METHODS FOR MOTOR GRADER SCARIFIERS

(71) Applicant: Caterpillar Inc., Peoria, IL (US)

(72) Inventors: Michael C. Gentle, Maroa, IL (US); Ethan M. Tevis, Bloomington, IL (US); David L. Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 1034 days.

(21) Appl. No.: 17/364,382

(22) Filed: Jul. 16, 2021

(65) Prior Publication Data

US 2023/0017936 A1 Jan. 19, 2023

(51) Int. Cl.

| | |
|---|---|
| ***E02F 3/84*** | (2006.01) |
| ***E02F 3/76*** | (2006.01) |
| ***E02F 9/24*** | (2006.01) |

(52) U.S. Cl.

CPC ..... *E02F 3/841* (2013.01); *E02F 3/7604* (2013.01); *E02F 3/764* (2013.01); *E02F 3/844* (2013.01); *E02F 9/24* (2013.01)

(58) Field of Classification Search

CPC ..... E02F 3/841; E02F 3/7604; E02F 3/764; E02F 3/844; E02F 9/24; E02F 9/205; E02F 3/7645; E02F 3/7654; E02F 9/2033; E02F 3/765

See application file for complete search history.

(56) References Cited

U.S. PATENT DOCUMENTS

| | | | | |
|---|---|---|---|---|
| 3,907,041 | A | 9/1975 | Manor | |
| 4,643,261 | A | 2/1987 | Long | |
| 5,375,663 | A * | 12/1994 | Teach | E02F 3/847 701/50 |
| 5,646,844 | A * | 7/1997 | Gudat | G05D 1/0274 701/50 |
| 6,028,524 | A * | 2/2000 | Hartman | E02F 3/7654 340/684 |
| 7,676,967 | B2 | 3/2010 | Gharsalli et al. | |
| 9,637,889 | B2 | 5/2017 | Elkins | |
| 2008/0263912 | A1 * | 10/2008 | Gharsalli | E02F 9/2033 37/382 |
| 2015/0308074 | A1 * | 10/2015 | Zhdanov | E02F 3/847 701/50 |
| 2020/0173135 | A1 * | 6/2020 | Gentle | E02F 3/7627 |
| 2020/0173136 | A1 * | 6/2020 | Gentle | E02F 3/7663 |
| 2020/0173141 | A1 * | 6/2020 | Gentle | E02F 3/765 |
| 2020/0362542 | A1 | 11/2020 | Veasy et al. | |

(Continued)

FOREIGN PATENT DOCUMENTS

| | | |
|---|---|---|
| CN | 102322080 B | 8/2015 |
| JP | 4030051 B2 | 1/2008 |

*Primary Examiner* — Mussa A Shaawat

(57) ABSTRACT

The present disclosure is directed to systems and methods for operating a grading machine. The method includes (i) receiving information indicating a current position of a moldboard of the grading machine; (ii) determining if the moldboard is moving toward an avoidance zone, and the avoidance zone is defined by a distance from a scarifier of the grading machine; and (iii) in response to a determination that the moldboard is moving toward the avoidance zone, adjusting at least one operating parameter of the moldboard or the scarifier of the grading machine.

20 Claims, 10 Drawing Sheets

(56) References Cited

U.S. PATENT DOCUMENTS

| | | | | |
|---|---|---|---|---|
| 2021/0136990 | A1* | 5/2021 | Henry | A01B 71/08 |
| 2022/0105803 | A1* | 4/2022 | Wuisan | E02F 3/841 |
| 2022/0127821 | A1* | 4/2022 | Kuehn | E02F 3/7636 |
| 2023/0257964 | A1* | 8/2023 | Nakano | E02F 3/841 701/50 |
| 2023/0417021 | A1* | 12/2023 | Okamune | E02F 3/841 |

* cited by examiner

DAMAGE AVOIDANCE SYSTEMS AND METHODS FOR MOTOR GRADER SCARIFIERS

TECHNICAL FIELD

The present technology is directed to systems and methods for operating graders or other suitable machines, vehicles, and devices. More particularly, systems and methods for avoiding damages to a motor grader caused by a scarifier contacting other components of the motor grader.

BACKGROUND

When operating a motor grader, an operator needs to properly position its components such as a moldboard, a scarifier, etc. It can be difficult for inexperienced operators (sometimes even experienced ones) to properly position and operate the components of the motor grader due to the complexity of assigned tasks (e.g., requiring cooperation of multiple components of the motor grader). U.S. Patent Publication No. 20160362870 (Elkins) discloses an "automated moldboard draft control system . . . with a sensor system and electronic controller for determining a required wheel tilt to overcome anticipated draft forces resulting from the angle to which the moldboard is adjusted." (Abstract.) More particularly, in paragraph [0038], Elkins programs its grader "to orient the wheels and adjust the [grader] to be at the highest performance levels based on historical data . . . . Having the wheels at the proper lean angle can prolong tire life and prevent damage." However, Elkins fails to disclose or suggest how to properly avoid damage caused by components such as a scarifier contacting other components. Thus, it would be advantageous to have an improved method and system to address the foregoing needs.

SUMMARY OF THE INVENTION

The present technology is directed to systems and methods for operating machine on a surface. In some embodiments, the machine can be a motor grader or a grading machine having multiple components (e.g., a scarifier, a moldboard etc.) coordinating with one another to perform a task (e.g., removing snow from a road surface). The scarifier of a motor grader can be used for conditioning soils, mixing multiple materials, loosening hard materials, ripping asphalt, etc. The moldboard of a motor grader can be used for flattening/conditioning a surface, removing/moving materials on the surface, etc. In a motor grader, the scarifier is usually positioned adjacent to the moldboard. Therefore, there can be potential interference when operating these two components and so operator attention is required to avoid accidental damage. The present technology provides solutions to address the foregoing issue.

The present method includes (i) receiving information indicating a current position of a moldboard of a grading machine; (ii) determining if the moldboard is moving toward an avoidance zone defined by a distance from a scarifier of the grading machine; and (iii) in response to a determination that the moldboard is moving toward the avoidance zone, adjusting at least one operating parameter of the moldboard or the scarifier of the grading machine. In some embodiments, the moldboard is coupled to a drawbar of the grading machine and configured to rotate about a generally vertical axis. The moldboard includes two ends configured to move vertically relative to the surface, and, depending upon their position at the time of movement, either of these two ends can potentially interfere with the scarifier. The avoidance zone is defined by a distance (a safety distance, such as less than 1 to 5 inches) from the scarifier. By this arrangement, the present method enables an operator to operate the grading machine without potential interference of or causing damage to the scarifier and the moldboard. In some embodiments, the present method can also prevent the scarifier from hitting the drawbar. For example, in response to a determination that the avoidance zone is moved toward the drawbar (due to the movement of the scarifier), the present method can adjust the position/operation of the scarifier accordingly.

Another aspect of the present technology is to provide a machine or system that can be autonomously (or partially autonomously) and effectively operated. The machine can include, for example, a processor and a memory communicably coupled to the processor. The memory can store computer executable instructions that, when executed by the processor, cause the machine to: (i) receive information indicating a current position of a moldboard of the grading machine; (ii) determine if the moldboard is moving toward an avoidance zone, and the avoidance zone is defined by a distance from a scarifier of the grading machine; and (iii) in response to a determination that the moldboard is moving toward the avoidance zone, adjust at least one operating parameter of the moldboard or the scarifier of the grading machine.

BRIEF DESCRIPTION OF THE DRAWINGS

Non-limiting and non-exhaustive examples are described with reference to the following figures.

DETAILED DESCRIPTION

Various aspects of the disclosure are described more fully below with reference to the accompanying drawings, which form a part hereof, and which show specific exemplary aspects. Different aspects of the disclosure may be implemented in many different forms and the scope of protection sought should not be construed as limited to the aspects set forth herein. Rather, these aspects are provided so that this disclosure will be thorough and complete, and will fully convey the scope of the aspects to those skilled in the art. Aspects may be practiced as methods, systems, or devices. Accordingly, aspects may take the form of a hardware implementation, an entirely software implementation, or an implementation combining software and hardware aspects. The following detailed description is, therefore, not to be taken in a limiting sense.

Figure 1A:
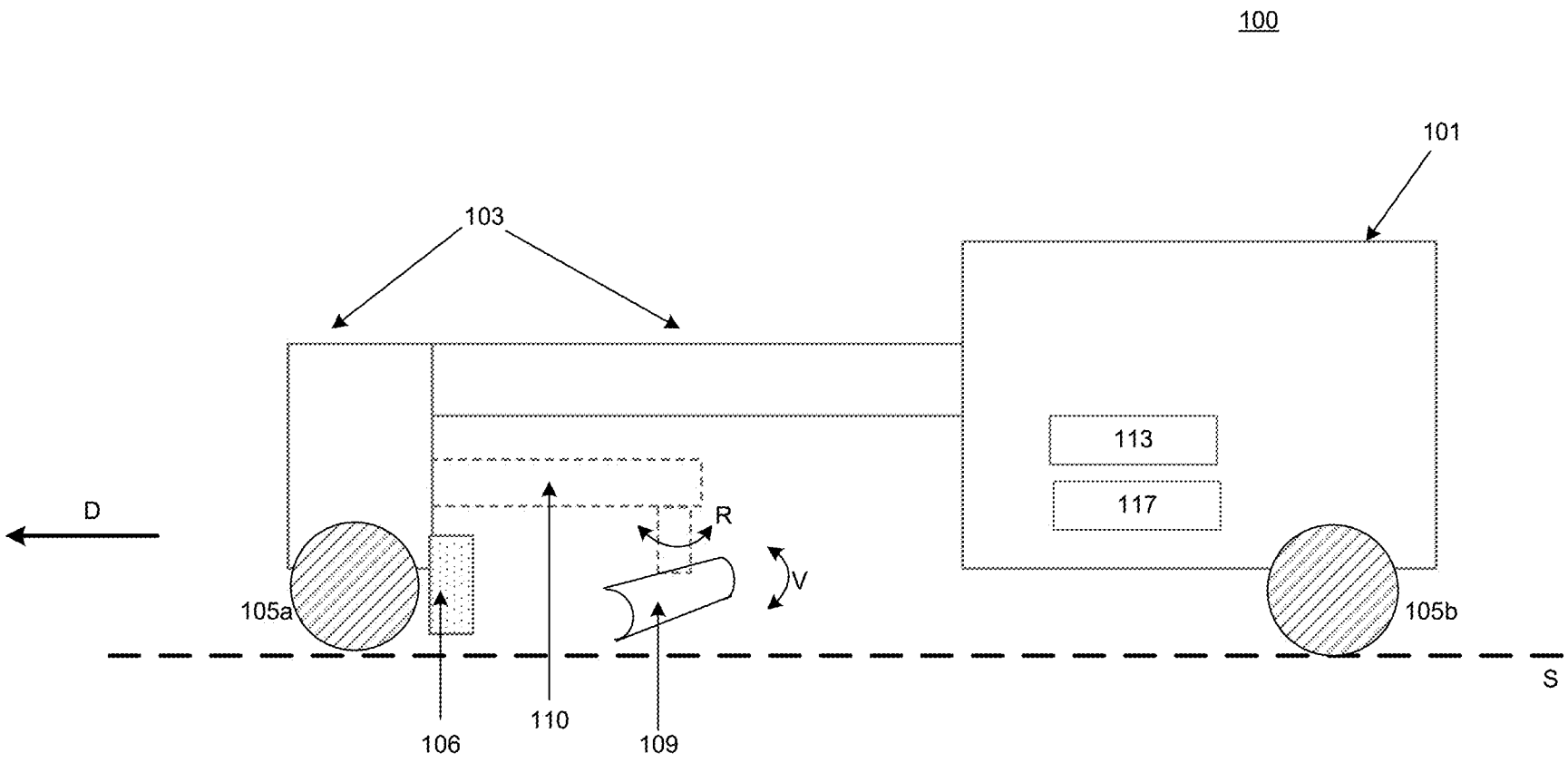
FIG. 1A is a schematic diagram (side view) illustrating a machine in accordance with embodiments of the present technology.

FIG. 1A is a schematic diagram (side view) illustrating a machine 100 in accordance with embodiments of the present technology. The machine 100 travels on a surface S. As shown, the machine 100 includes a main body 101, a front unit 103, and multiple wheels 105 (including front wheels 105*a*), a scarifier 106 carried by the front unit 103, and a moldboard 109. The front unit 103 can be pivotably connected to the main body 101 by a suitable coupling (not shown). The front unit 103 includes a driving assembly 110 configured to change the tilt about a horizontal axis (e.g., direction V as indicated) or rotate about a vertical axis (e.g., direction R as indicated) the moldboard 109. The movement/rotation of the moldboard 109 is discussed in detail with reference to FIG. 1B. In some embodiments, the driving assembly 110 can include a drawbar, a circle driving component, a center shifting component, a drive motor, one or more hydraulic cylinders, etc. In some embodiments, the scarifier 106 can also be moved and/or rotated during operation (e.g., adjusting its position in response to different surface conditions).

The machine 100 also includes a controller (or a processor) 113 positioned in the main body 101 and configured to coordinate the operations of the components of the machine 100 such as the scarifier 106 and the moldboard 109. In some embodiments, the controller 113 receives instructions from an operator regarding how to operate the machine 100. In some embodiments, one or more sets of "favorite" operational instructions can be stored in a storage device or memory 117 of the machine 100. Each set of operational instructions corresponds to parameters regarding how to operate and/or position the scarifier 106, the moldboard 109, and/or other suitable components of the machine 100 in different situations or scenarios. The set of operational instructions include information regarding one or more "avoidance zones" defined based a distance from the scarifier 106. The information regarding one or more "avoidance zones" is used to avoid potential interference between the scarifier 106 and the moldboard 109, as discussed in detail with reference to FIG. 1B.

Figure 1B:
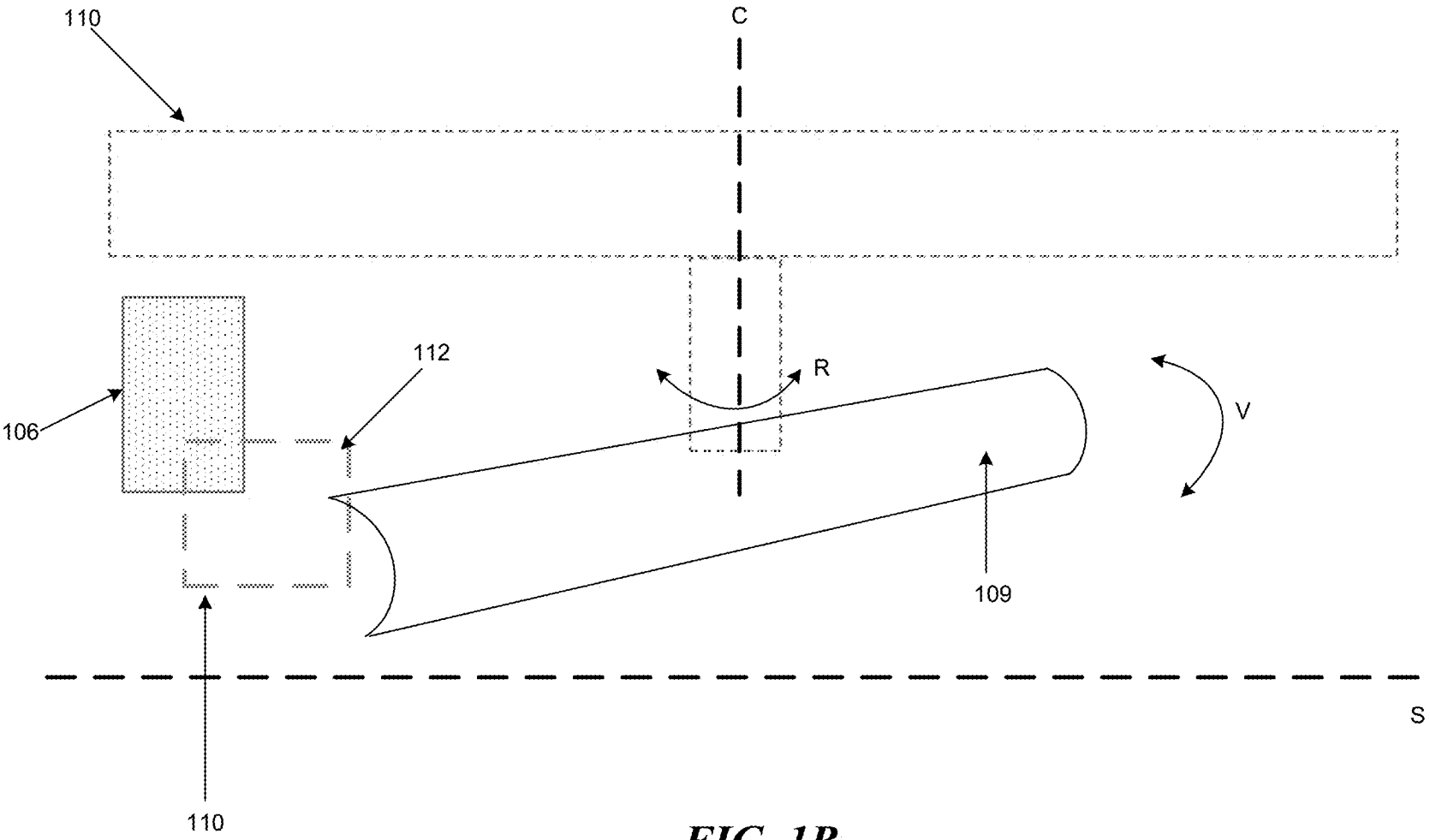
FIG. 1B is a schematic diagram (side view) illustrating operations of a moldboard of a machine in accordance with embodiments of the present technology.

FIG. 1B is a schematic diagram (side view) illustrating operations of the moldboard 109 in accordance with embodiments of the present technology. As shown in FIG. 1B, the driving assembly 110 can rotate the moldboard 109 about an axis C in direction R (e.g., in a generally horizontal plane which could be parallel to the surface) and/or move the moldboard 109 vertically in direction V. In other words, the moldboard 109 can have a "three-dimensional" movement/rotation such that it can potentially be in contact with the scarifier 106 in an avoidance zone 112 and cause damages.

Once the avoidance zone 112 is defined, the operations of the scarifier 106 and the moldboard 109 can be managed and/or restricted such that these two components would not be in the avoidance zone 112 at the same time. In some embodiments, in response to a determination that the moldboard 109 is moving toward the avoidance zone 112, the machine 100 can adjust at least one operating parameter of the moldboard 109 or the scarifier 106. In some embodiments, the at least one operating parameter can include a moving speed of the moldboard 109, a moving speed of the scarifier 106, a moving direction of the moldboard 109, a moving direction of the scarifier 106, a rotational speed of the moldboard 109, a rotational direction of the moldboard 109, etc.

In some embodiments, the machine 100 can generate and send an alarm to the operator, in response to the determination that the moldboard 109 is moving toward the avoidance zone 112. In such embodiments, the at least one operating parameter of the moldboard 109 can be manually adjusted by the operator in response to the alarm.

In some embodiments, the avoidance zone 112 can be defined based a distance from the scarifier 106. For example, the avoidance zone 112 can be defined as a space extending one to five inches from the scarifier 106. In some embodiments, the avoidance zone 112 can be defined as a spherical-shaped space or a generally (e.g., with about 10% variance) spherical-shaped shape. In some embodiments, the avoidance zone 112 can include other suitable or customized shapes.

In some embodiments, the distance can be calculated from center of gravity or geometric center of the scarifier 106. In some embodiments, the distance can be calculated from at least one surface (e.g., top, bottom, side, etc.) of the scarifier 106. In some embodiments, the distance can be calculated from at least one surface point of the scarifier 106.

In some embodiments, the distance can be a fixed distance such as one to ten inches. In some embodiments, the distance can correspond to the dimensions of the scarifier 106 or the moldboard 109 (e.g., 3% of the length of the scarifier 106; 7% of the width of the moldboard 109; 12% of the height of the scarifier 106; 5% of a vertical moving range of the moldboard 109).

By managing the operations of the scarifier 106 and/or the moldboard 109 based on the avoidance zone 112, the present technology can effectively avoid potential interference of these components and therefore avoid damages thereof.

Figure 2A:
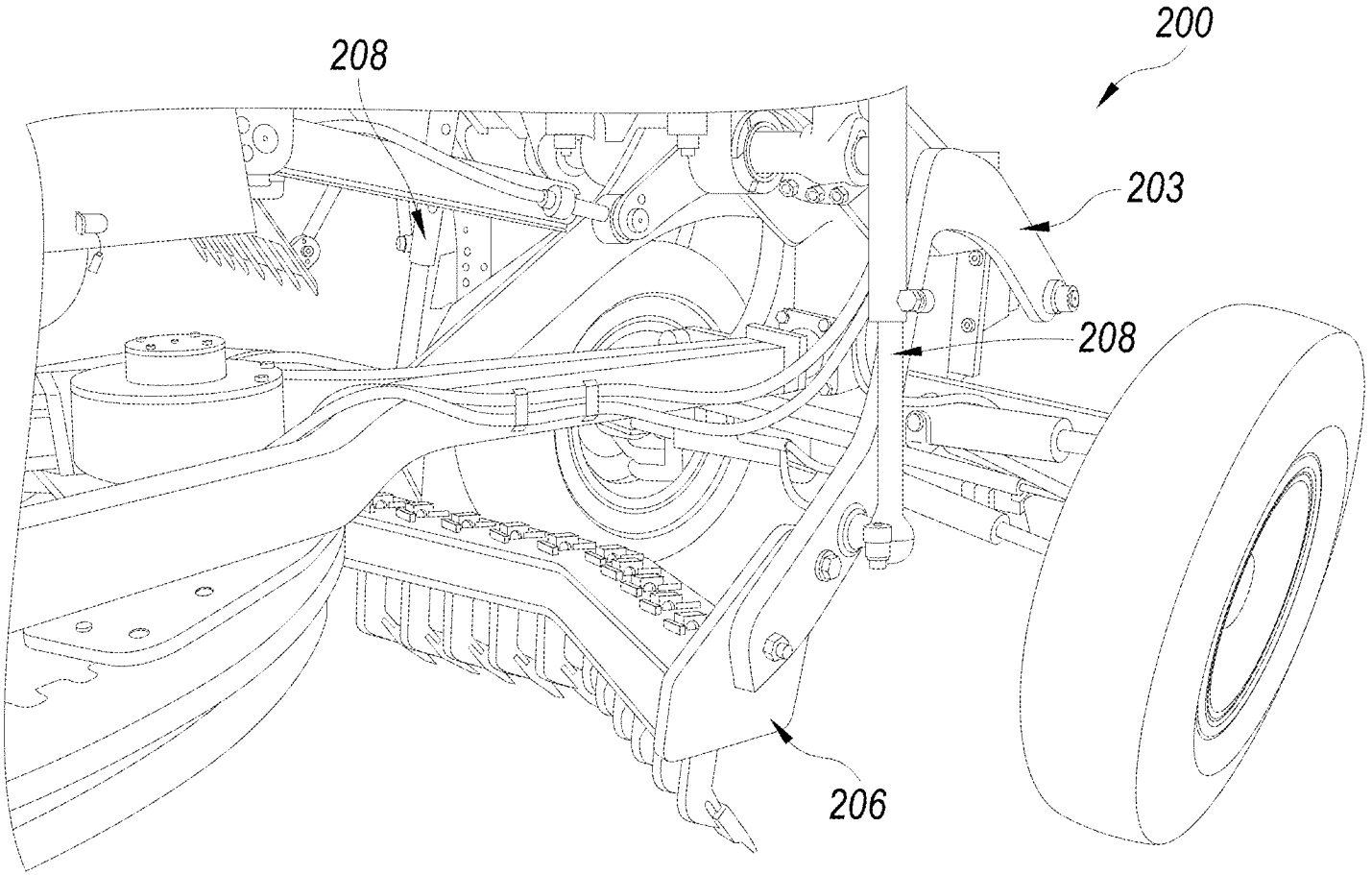
FIG. 2A is a perspective view of a scarifier of a grading machine in accordance with embodiments of the present technology.

FIG. 2A is a perspective view of a scarifier 206 of a grading machine 200 in accordance with embodiments of the present technology. As shown, the grading machine 200 includes a front unit 203 coupled to the scarifier 206. The scarifier 206 can be moved or operated by a connecting component 208, which can be a hydraulic actuator. In some embodiments, the scarifier 206 can be moved and/or rotated by other suitable components.

Figure 2B:
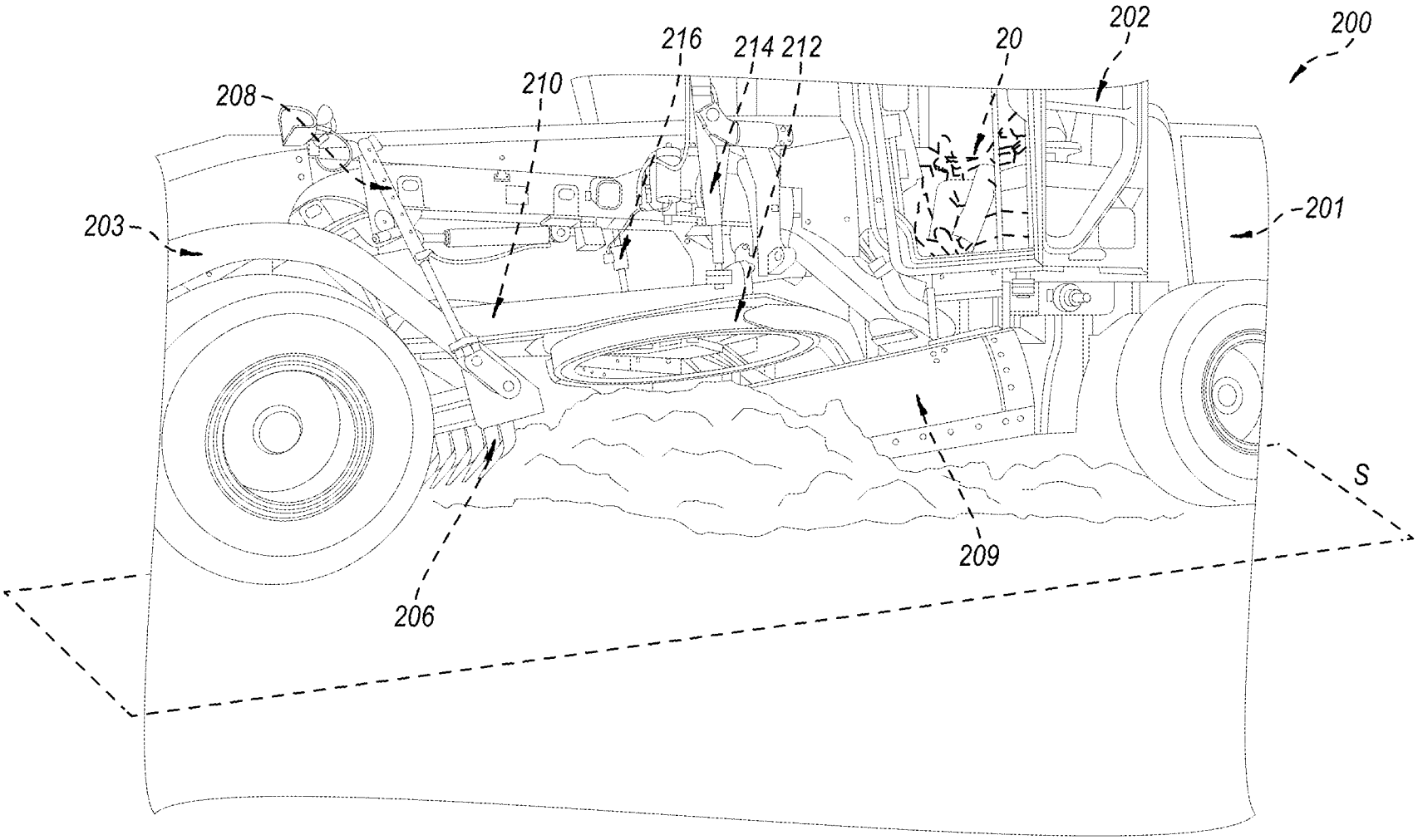
FIG. 2B is a perspective view illustrating operations of a scarifier and a moldboard of a grading machine in accordance with embodiments of the present technology.

FIG. 2B is a perspective view illustrating operations of the scarifier 206 and a moldboard 209 of the grading machine 200 in accordance with embodiments of the present technology. The machine 200 travels on a surface S. As shown in FIG. 2B, the grading machine 200 includes a main body 201 having a cabin 202 for an operator 20 to sit in.

The moldboard 209 is coupled to a driving component 210 (which can be what is known in the art as a "DCM" (drawbar, circle, and moldboard). The driving component 210 is configured to move and rotate the moldboard 209. The driving component 210 includes a connecting plate or circle 212, a left blade lift cylinder 214 and a right blade lift cylinder 216. The connecting plate 212 is configured to rotate the moldboard 209 in a generally-horizontal plane. The left blade lift cylinder 214 and the right blade lift cylinder 216 are configured to move the moldboard 209 vertically. During operation, at least one "avoidance zone" is implemented so as to avoid potential inference between the moldboard 209 and the scarifier 206, as discussed in detail with reference to FIG. 2C.

Figure 2C:
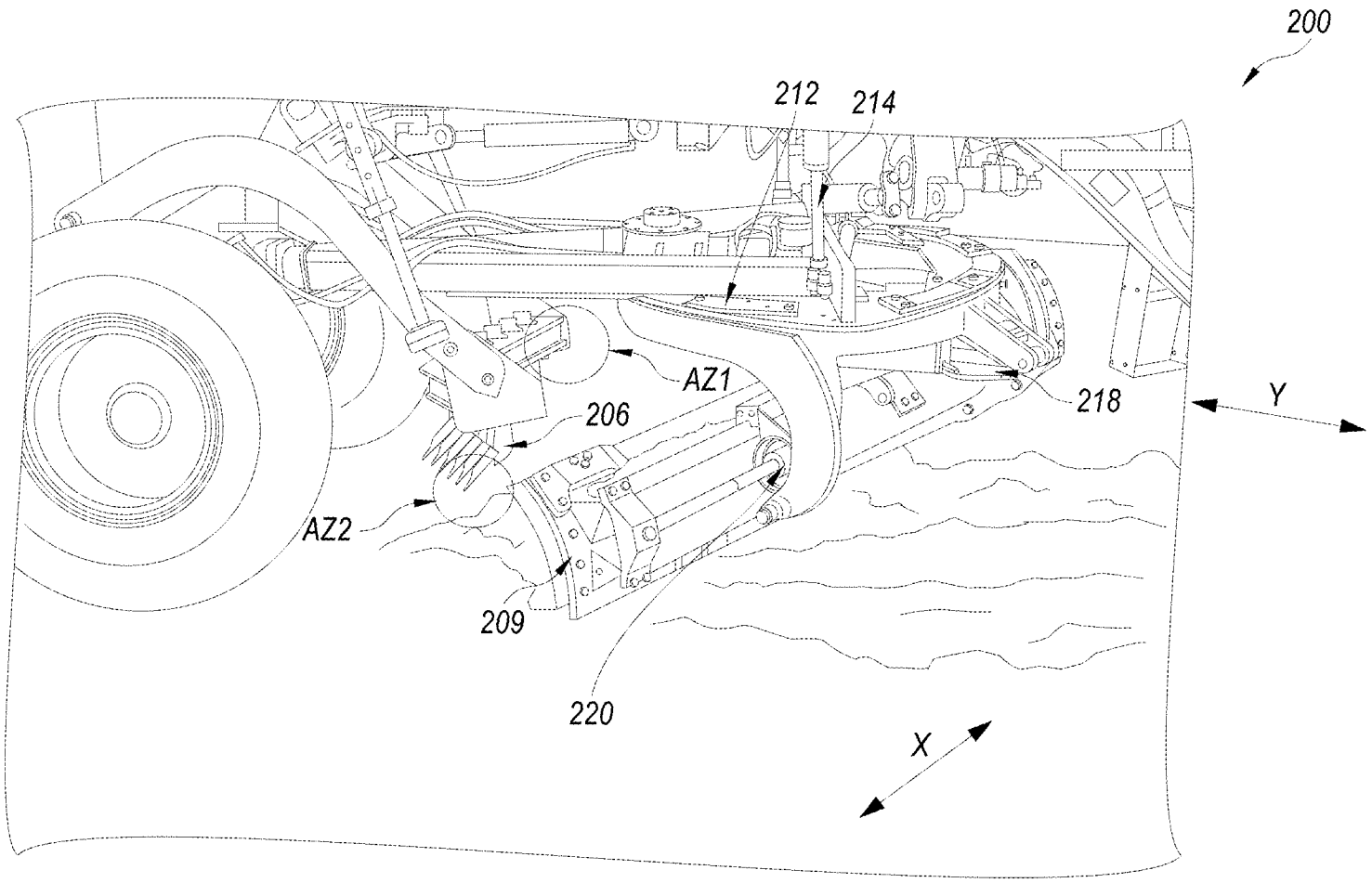
FIG. 2C is a perspective view illustrating potential interference between a scarifier and a moldboard of a grading machine in accordance with embodiments of the present technology.

FIG. 2C is a perspective view illustrating potential interference between the scarifier 206 and the moldboard 209 of the grading machine 200. Two avoidance zones AZ1, AZ2 are shown in FIG. 2C. During operation, the present system prevents the moldboard 209 from moving into the avoidance zones AZ1, AZ2 so as to avoid potential inference with the scarifier 206. Also shown in FIG. 2C is a blade sideshift cylinder 220 configured to move the moldboard 209 in direction X. Also, a blade pitch cylinder 218 is configured to move the moldboard 209 to rotate about the moldboard's widthwise axis so that, for example, the top edge of the moldboard 209 can be positioned ahead of, above, or behind the cutting edge of the moldboard 209. Embodiments of the components that move/rotate the moldboard are also disclosed in FIG. 4B.

Figure 3:
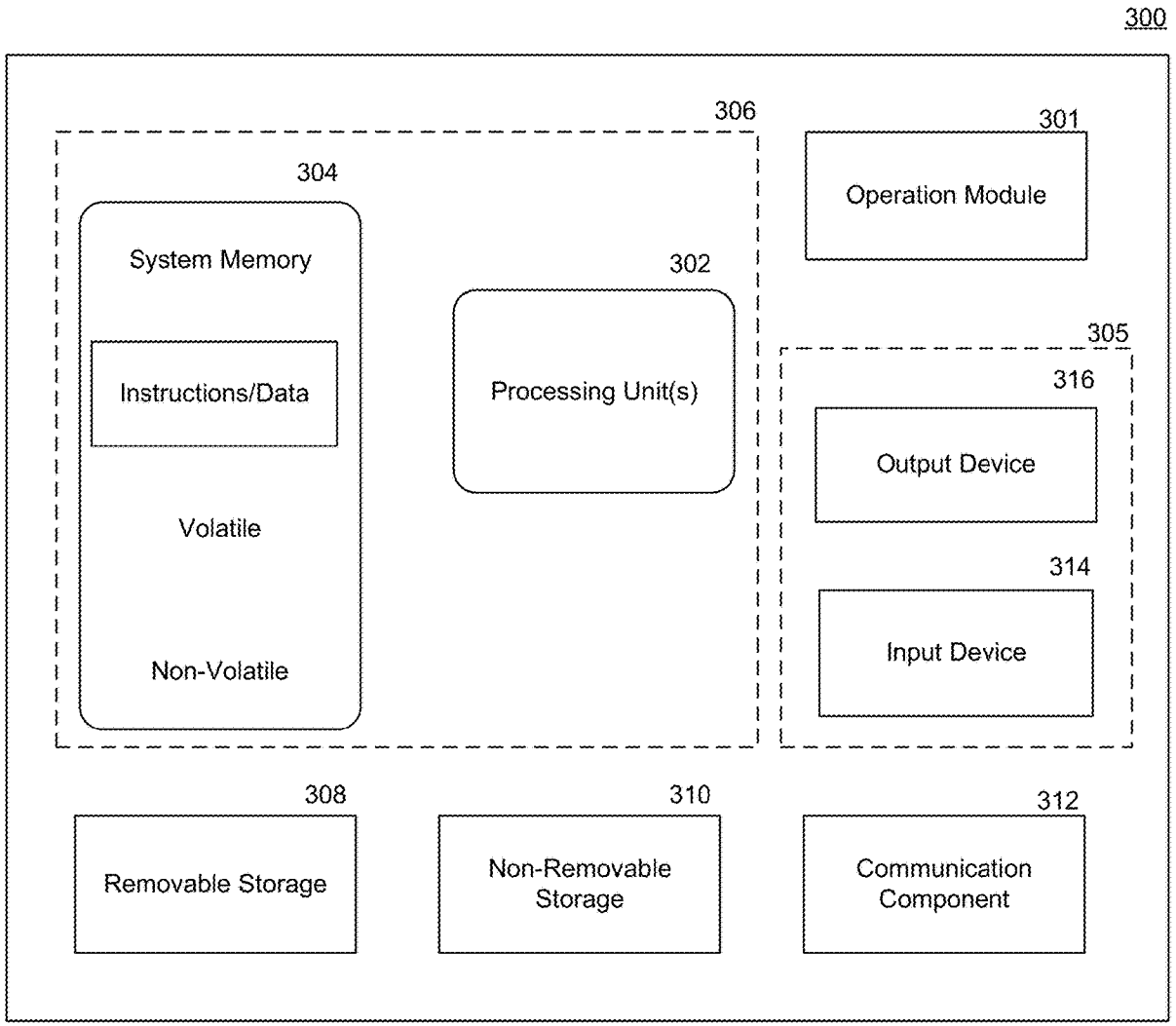
FIG. 3 is a schematic diagram illustrating components in a computing device (e.g., a server) configured to interact with a machine in accordance with embodiments of the present technology.

FIG. 3 is a schematic diagram illustrating components in a computing device 300 in accordance with embodiments of the present technology. The computing device 300 can be used to implement methods (e.g., FIGS. 5 and 6) discussed herein. Note the computing device 300 is only an example of a suitable computing device and is not intended to suggest any limitation as to the scope of use or functionality. Other well-known computing systems, environments, and/or configurations that may be suitable for use include, but are not limited to, personal computers (PCs), server computers, hand-held or laptop devices, multiprocessor systems, microprocessor-based systems, programmable consumer electronics such as smart phones, network PCs, minicomputers, mainframe computers, distributed computing environments that include any of the above systems or devices, and the like.

In its most basic configuration, the computing device 300 includes at least one processing unit 302 and a memory 304. Depending on the exact configuration and the type of computing device, the memory 304 may be volatile (such as a random-access memory or RAM), non-volatile (such as a read-only memory or ROM, a flash memory, etc.), or some combination of the two. This basic configuration is illustrated in FIG. 3 by dashed line 306. Further, the computing device 300 may also include storage devices (a removable storage 308 and/or a non-removable storage 310) including, but not limited to, magnetic or optical disks or tape. Similarly, the computing device 300 can have an input device 314 such as keyboard, mouse, pen, voice input, etc. and/or an output device 316 such as a display, speakers, printer, etc. Also included in the computing device 300 can be one or more communication components 312, such as components for connecting via a local area network (LAN), a wide area network (WAN), cellular telecommunication (e.g. 3G, 4G, 5G, etc.), point to point, any other suitable interface, etc.

The computing device 300 can include an operation module 301 configured to implement methods for operating the machines based on one or more sets of parameters corresponding to components of the machines in various situations and scenarios. For example, the operation module 301 can be configured to operate the machines 100 and 200 based on one or more predetermined avoidance zones for the moldboard and the scarifier thereof. In some embodiments, the operation module 301 can be in form of tangibly-stored instructions, software, firmware, as well as a tangible device.

In some embodiments, the output device 316 and the input device 314 can be implemented as the integrated user interface 305. The integrated user interface 305 is configured to visually present information associated with inputs and outputs of the machines.

The computing device 300 includes at least some form of computer readable media. The computer readable media can be any available media that can be accessed by the processing unit 302. By way of example, the computer readable media can include computer storage media and communication media. The computer storage media can include volatile and nonvolatile, removable and non-removable media (e.g., removable storage 308 and non-removable storage 310) implemented in any method or technology for storage of information such as computer readable instructions, data structures, program modules or other data. The computer storage media can include, an RAM, an ROM, an electrically erasable programmable read-only memory (EEPROM), a flash memory or other suitable memory, a CD-ROM, digital versatile disks (DVD) or other optical storage, magnetic cassettes, magnetic tape, magnetic disk storage or other magnetic storage devices, or any other tangible medium which can be used to store the desired information.

The computing device 300 includes communication media or component 312, including non-transitory computer readable instructions, data structures, program modules, or other data. The computer readable instructions can be transported in a modulated data signal such as a carrier wave or other transport mechanism and includes any information delivery media. The term "modulated data signal" means a signal that has one or more of its characteristics set or changed in such a manner as to encode information in the signal. By way of example, and not limitation, the communication media can include wired media such as a wired network or direct-wired connection, and wireless media such as acoustic, radio frequency (RF), infrared and other wireless media. Combinations of the any of the above should also be included within the scope of the computer readable media.

The computing device 300 may be a single computer operating in a networked environment using logical connections to one or more remote computers. The remote computer may be a personal computer, a server, a router, a network PC, a peer device or other common network node, and typically includes many or all of the elements described above as well as others not so mentioned. The logical connections can include any method supported by available communications media. Such networking environments are commonplace in offices, enterprise-wide computer networks, intranets and the Internet.

Figure 4A:
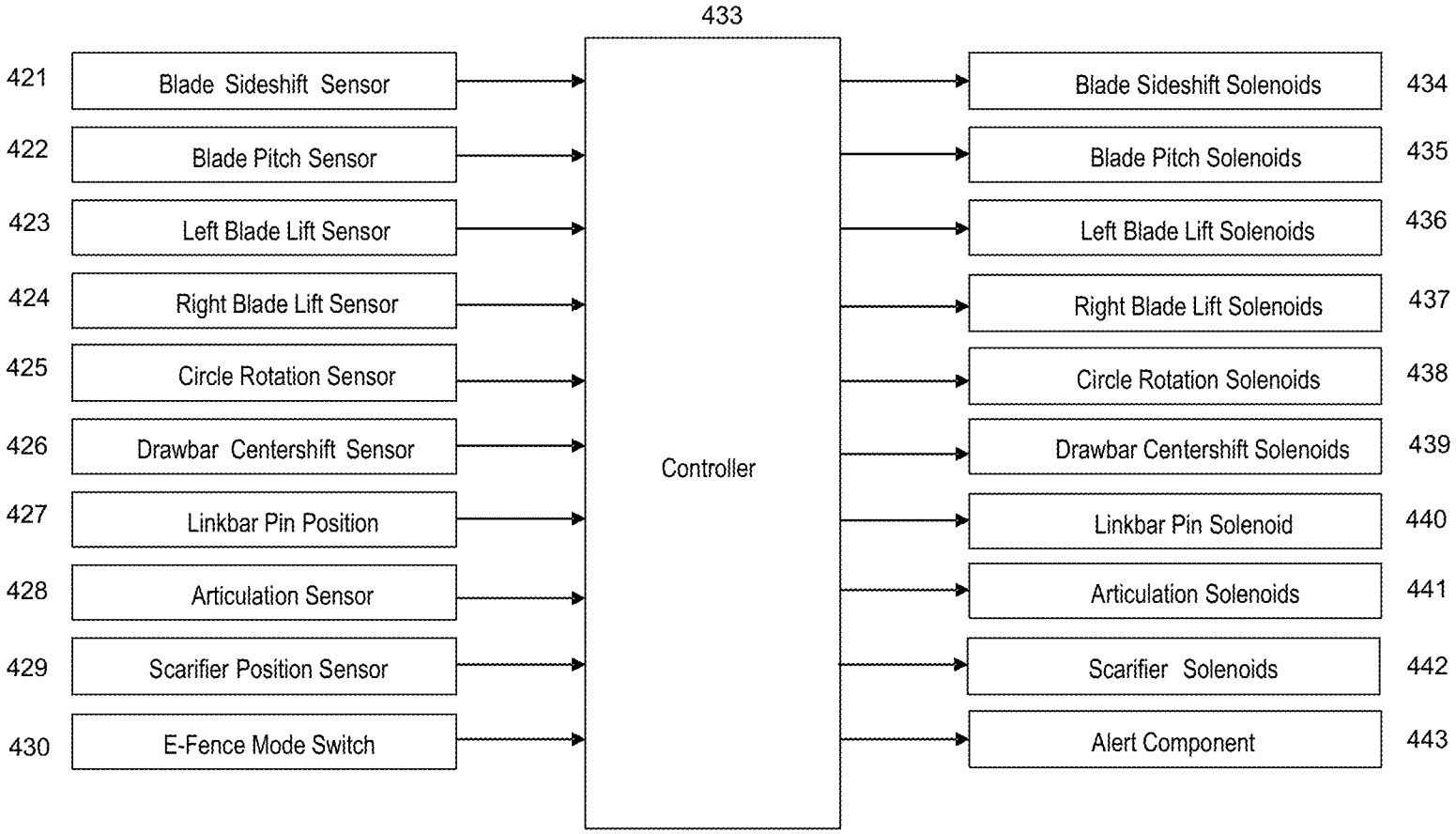
FIG. 4A is a schematic diagram illustrating components of a machine in accordance with embodiments of the present technology.

FIG. 4A is a schematic diagram illustrating components of a machine in accordance with embodiments of the present technology. The machine can include (i) a set of sensors configured to determine and/or measure statuses of the components of the machine; (ii) a controller 433 configured to receive the outputs of the sensors, and (iii) a set of operation components configured to operate the components of the machine as instructed by the controller 433.

These sensors can include a blade side-shift sensor 421, a blade pitch sensor 422, a left blade lift sensor 423, a right blade lift sensor 424, a circle rotation sensor 425, a drawbar center-shift sensor 426, a link-bar pin sensor 427, an articulation sensor 428, a scarifier position sensor 429, and an electronic fence sensor 430. The blade side-shift sensor 421 is configured to measure a side shift or movement of a moldboard (e.g., the moldboard 109 or 209). The blade pitch sensor 422 is configured to measure a pitch or steepness of a slope of the moldboard. The left and right blade lift sensors 423, 424 are configured to measure a horizontal level of the moldboard. The circle rotation sensor 425 is configured to measure a rotation of the moldboard.

The drawbar center-shift sensor 426 is configured to measure movement/rotation of the moldboard imparted by the drawbar (see, e.g., FIG. 1B). The link-bar pin sensor 427 is configured to measure a movement of a link bar, which can be used to move components such as the moldboard and/or other suitable components of the machine. The articulation sensor 428 is configured to measure an articulation angle (e.g., an angle formed between a center axis of the main body 101 of the machine 100 and an axis of the front unit 103 (which is pivotably connected to the main body 101). The scarifier position sensor 429 is configured to measure a position of the scarifier. The electronic fence mode switch 430 is configured to enable or disable the damage avoidance system discussed herein. In some embodiments, the sensors can also include a machine position sensor (not shown) configured to measure parameters relating to the position of the machine, such as the machine's pitch, yaw, roll, etc.

The controller 433 can (i) receive the outputs from the sensors/switch 421-430, (ii) calculate a distance between an object and a component of the machine (or a distance between two or more components of the machine), and (iii) instruct the corresponding operation components so as to operate the machine. The operation components can include a set of solenoids, such as a blade side-shift solenoid 434, a blade pitch solenoid 435, a left blade lift solenoid 436, a right blade lift solenoid 437, a circle rotation solenoid 438, a drawbar center-shift solenoid 439, a link-bar pin solenoid 440, an articulation solenoid 441, a scarifier solenoid 442, and an alert component 443. Solenoids are mentioned by way of example only, and other suitable actuators could be provided.

The blade side-shift solenoid 434 is configured to move or shift the moldboard to a side of the machine. The blade pitch solenoid 435 is configured to adjust the pitch of the moldboard. The left and right blade lift solenoid 436, 437 are configured to lift the moldboard at different sides.

The circle rotation solenoid 438 is configured to (generally horizontally) rotate the moldboard. The drawbar center-shift solenoid 439 is configured to move and/or (vertically) rotate the moldboard. The link-bar pin solenoid 440 is configured to lock and unlock the link bar. The articulation solenoid 441 is configured to adjust the articulation angle of the machine. The scarifier solenoid 442 is configured to adjust the position of the scarifier. The alert component 443 is configured to generate and send an alarm to an operator of the machine (e.g., in response to a determination that a component, such as the moldboard, is moving toward an avoidance zone).

Figure 4B:
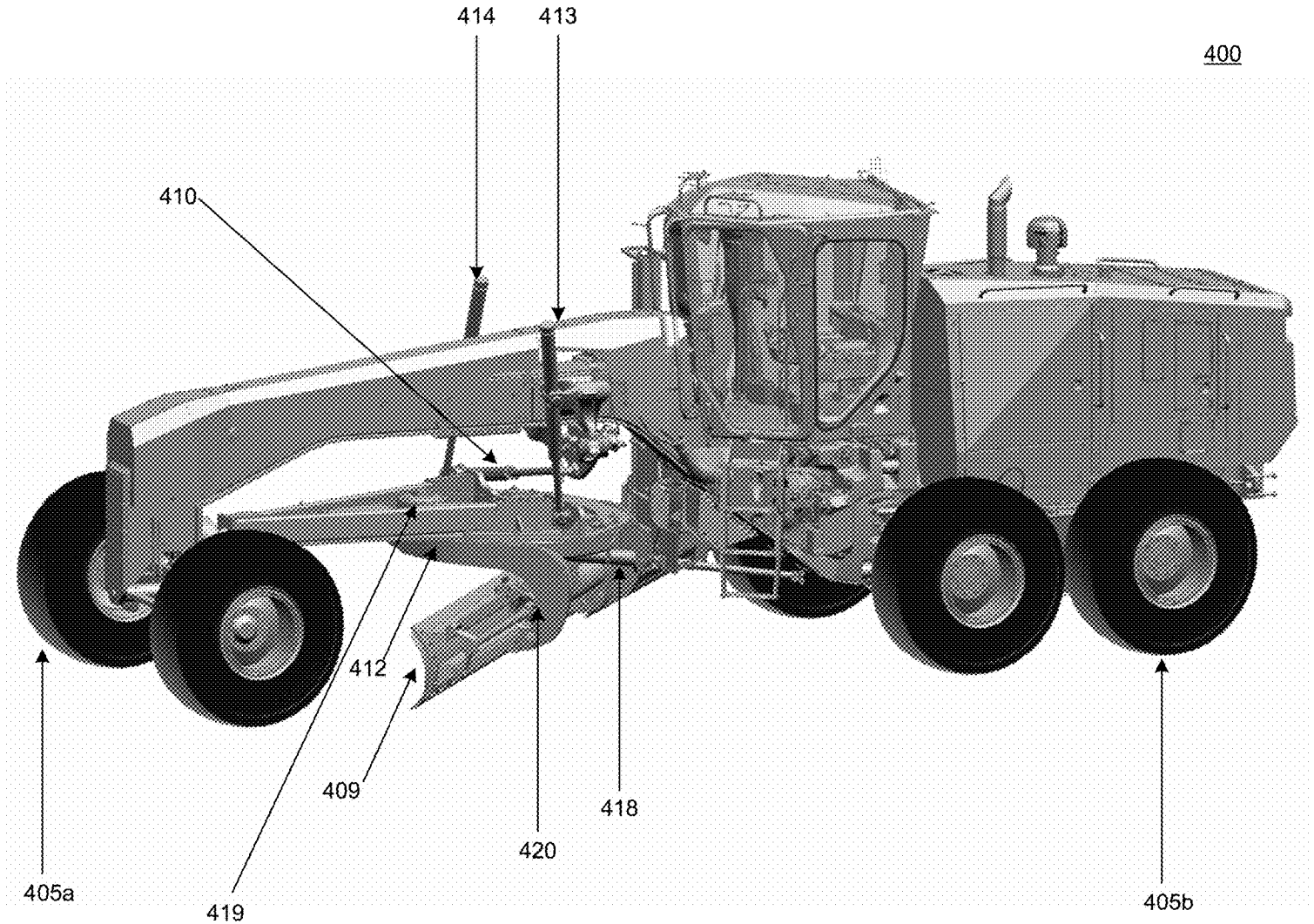
FIG. 4B is a schematic diagram illustrating components of a machine in accordance with embodiments of the present technology.

FIG. 4B is a schematic diagram illustrating components of a machine 400 in accordance with embodiments of the present technology. The machine 400 includes a blade pitch cylinder 418 and a blade side-shift cylinder 420 configured to move a moldboard 409. The machine 400 also includes a supporting component 410 configured to move and rotate the moldboard 409. In the illustrated embodiment, the supporting component 410 includes a circle 412, a left blade lift cylinder 413 and a right blade lift cylinder 414. The circle 412 is configured to rotate the moldboard 409 in a generally horizontal plane. The left blade lift cylinder 413 and the right blade lift cylinder 414 are configured to move the moldboard 409 vertically. In the illustrated embodiments, the driving component 410 also includes a circle drive motor 419 configured to move/rotate the moldboard 409.

Figure 5:
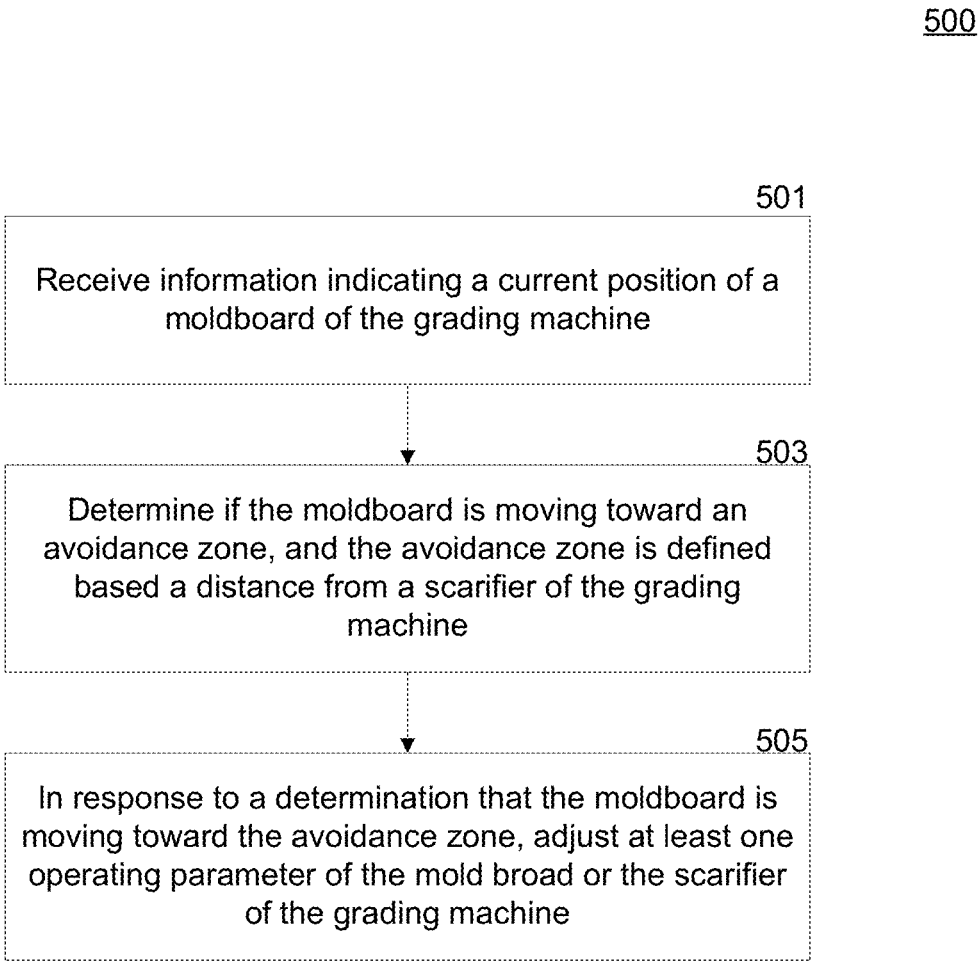
FIG. 5 is a flow diagram showing a method in accordance with embodiments of the present technology.

FIG. 5 is a flow diagram showing a method 500 in accordance with embodiments of the present technology. The method 500 can be implemented to operate a grading machine. The method 500 starts at block 501 by receiving information indicating a current position of a moldboard of the grading machine. At block 503, the method 500 continues by determining if the moldboard is moving toward an avoidance zone. The avoidance zone is defined based a distance from a scarifier of the grading machine. In some embodiments, the method 500 can include determining if the scarifier is moving toward the avoidance zone by determining if the scarifier is moving within "x" inches of a drawbar of the grading machine or the moldboard. At block 505, the method 500 continues by adjusting at least one operating parameter of the moldboard or the scarifier of the grading machine, in response to a determination that the moldboard is moving toward the avoidance zone.

In some embodiments, the at least one operating parameter includes a moving speed of the moldboard, a moving speed of the scarifier, a moving direction of the moldboard, a moving direction of the scarifier, a rotational speed of the moldboard, a rotational direction of the moldboard, etc. In some embodiments, the at least one operating parameter can also include positioned of the moldboard and/or the scarifier.

In some embodiments, the method 500 further includes sending an alarm to an operator of the grading machine, in response to the determination that the moldboard is moving toward the avoidance zone. In some embodiments, the alarm can include a sound, a light, a visual presentation, a tactile signal, etc. In some embodiments, the at least one operating parameter of the moldboard of the grading machine can be manually adjusted by the operator in response to the alarm.

In some embodiments, the avoidance zone can be defined based a distance from the scarifier. In some embodiments, the avoidance zone can be defined as a space within one to ten inches from the scarifier. In some embodiments, the avoidance zone can be defined as a spherical-shaped space or a generally (e.g., with about 10% variance) spherical-shaped shape. In some embodiments, the avoidance zone can include other suitable or customized shapes.

Figure 6:
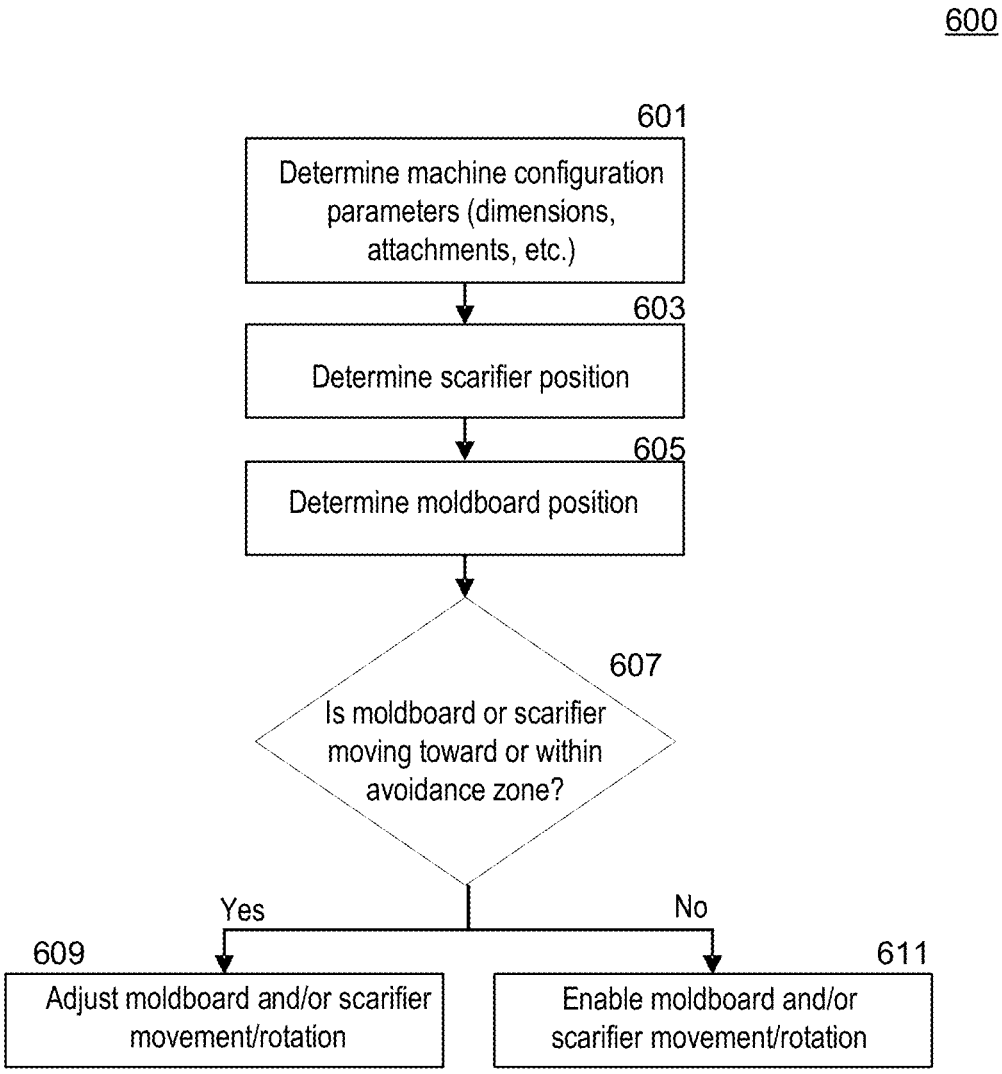
FIG. 6 is a flow diagram showing a method in accordance with embodiments of the present technology.

FIG. 6 is a flow diagram showing a method 600 in accordance with embodiments of the present technology. The method 600 can be implemented to operate a grading machine. The method 600 starts at block 601 by determining machine configuration parameters such as dimensions of components of the machine, the existence of additional attachments to these components, etc. At block 603, the method 600 continues by determining a position of the scarifier. At block 605, the method 600 continues by determining a position of the moldboard. At decision block 607, the method 600 decides whether the moldboard or the scarifier is within or moving toward an avoidance zone. If affirmative, the process goes to block 609 and adjusts the movements/rotations of the moldboard and/or the scarifier. If negative, the process goes to block 611 and enables/permits the movements/rotations of the moldboard and/or the scarifier.

INDUSTRIAL APPLICABILITY

The systems and methods described herein can help with operation of a grading machine at a work site. The methods enable an operator, experienced or inexperienced, to effectively coordinate and control components (such as a moldboard, a scarifier, etc.) of the grading machine. The present systems and methods can also be implemented to manage multiple industrial machines, vehicles and/or other suitable devices such as surface conditioning machines, etc.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the claims are not to be limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the term "and/or" when used in the phrase "A and/or B" means "A, or B, or both A and B." A similar manner of interpretation applies to the term "and/or" when used in a list of more than two terms.

The above detailed description of embodiments of the technology are not intended to be exhaustive or to limit the technology to the precise forms disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. Additionally, the term "comprising" is used throughout to mean including at least the recited feature(s) such that any greater number of the same feature and/or additional types of other features are not precluded, unless context suggests otherwise. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Any listing of features in the claims should not be construed as a Markush grouping.

The invention claimed is:

1. A method for operating a grading machine on a surface, comprising:

receiving information indicating a current position of a moldboard of the grading machine, wherein the moldboard is coupled to a drawbar of the grading machine and configured to rotate about an axis, and wherein the moldboard includes two ends configured to move vertically relative to the surface;

determining if the moldboard is moving toward an avoidance zone via at least one moldboard sensor and a positioning sensor for a scarifier of the grading machine, wherein the avoidance zone is defined by a distance from the scarifier to the moldboard, and wherein the distance is measured when both the scarifier and the moldboard are capable of being moved or rotated in an operation; and in response to a determination that the moldboard is moving toward the avoidance zone, adjusting at least one operating parameter of the moldboard or the scarifier of the grading machine.

2. The method of claim 1, wherein the at least one operating parameter includes at least one of:

a moving speed of the moldboard;

a moving speed of the scarifier;

a moving direction of the moldboard;

a moving direction of the scarifier;

a rotational speed of the moldboard; and/or a rotational direction of the moldboard.

3. The method of claim 1, wherein the avoidance zone includes a first avoidance zone and a second avoidance zone.

4. The method of claim 3, wherein the first avoidance zone is at a first side of the scarifier and the second avoidance zone is at a second side of the scarifier opposite to the first side.

5. The method of claim 3, wherein the first avoidance zone is at a first location adjacent to the scarifier and the second avoidance zone is at a second location away from the first location.

6. The method of claim 3, wherein the first avoidance zone is at a left side of the machine and the second avoidance zone is at a right side of the machine.

7. The method of claim 1, further comprising, in response to a determination that the avoidance zone is moved toward the drawbar of the grading machine, adjusting the at least one operating parameter of the scarifier of the grading machine.

8. The method of claim 1, further comprising sending an alarm to an operator of the grading machine, in response to the determination that the moldboard is moving toward the avoidance zone.

9. The method of claim 8, wherein the at least one operating parameter of the moldboard or the scarifier of the grading machine is manually adjusted by the operator in response to the alarm.

10. The method of claim 1, wherein the avoidance zone has a spherical shape.

11. The method of claim 1, wherein the avoidance zone has a three-dimensional shape corresponding to a shape of the scarifier.

12. The method of claim 1, wherein the distance from the scarifier is less than 1 inch.

13. The method of claim 1, wherein the distance from the scarifier is less than 3 inches.

14. The method of claim 1, wherein the distance from the scarifier is less than 5 inches.

15. A grading machine comprising:

a processor;

a memory communicably coupled to the processor, the memory comprising computer executable instructions that, when executed by the processor, cause the grading machine to:

receive information indicating a current position of a moldboard of the grading machine, wherein the moldboard is coupled to a drawbar of the grading machine and configured to rotate about an axis, and wherein the moldboard includes two ends configured to move vertically relative to the drawbar;

determine if the moldboard is moving toward an avoidance zone via at least one moldboard sensor and a position sensor for a scarifier of the grading machine, wherein the avoidance zone is defined by a distance from the scarifier to the moldboard, and wherein the distance is measured when both the scarifier and the moldboard are capable of being moved or rotated in an operation; and in response to a determination that the moldboard is moving toward the avoidance zone, adjust one or more operating parameters of the moldboard or the scarifier of the grading machine.

16. The grading machine of claim 15, wherein the one or more operating parameters includes two or more of: a moving speed of the moldboard, a moving speed of the scarifier, a moving direction of the moldboard, a moving direction of the scarifier, a rotational speed of the moldboard, and a rotational direction of the moldboard.

17. The grading machine of claim 15, wherein the computer executable instructions, when executed by the processor, are configured to:

send an alarm to an operator of the grading machine, in response to the determination that the moldboard is moving toward the avoidance zone.

18. The grading machine of claim 15, wherein the avoidance zone has a spherical shape.

19. The grading machine of claim 15, wherein the distance from the scarifier is less than 5 inches.

20. A method for operating a grading machine, comprising:

receiving information indicating an operation of a moldboard of the grading machine, wherein the moldboard is coupled to a drawbar of the grading machine and configured to rotate about an axis, and wherein the operation of the moldboard includes a movement and/or a rotation;

determining if the operation of the moldboard results in a portion of the moldboard moving into an avoidance zone via at least one moldboard sensor and a position sensor for a scarifier of the grading machine, wherein the avoidance zone is defined by a distance from the scarifier to the moldboard, and wherein the distance is measured when both the scarifier and the moldboard are capable of being moved or rotated in an operation; and in response to a determination that the moldboard is moving into the avoidance zone, adjusting at least one operating parameter of the moldboard or the scarifier of the grading machine.

* * * * *